US009932167B2

(12) United States Patent
Ogata

(10) Patent No.: US 9,932,167 B2
(45) Date of Patent: Apr. 3, 2018

(54) REMAINING-AMOUNT REDUCTION MEMBER

(71) Applicant: TOYO AEROSOL INDUSTRY CO., LTD., Tokyo (JP)

(72) Inventor: Ken Ogata, Tokyo (JP)

(73) Assignee: TOYO AEROSOL INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 15/420,241

(22) Filed: Jan. 31, 2017

(65) Prior Publication Data

US 2017/0137208 A1 May 18, 2017

Related U.S. Application Data

(63) Continuation of application No. PCT/JP2015/062557, filed on Apr. 24, 2015.

(51) Int. Cl.
*B65D 35/56* (2006.01)
*B65D 83/32* (2006.01)
(Continued)

(52) U.S. Cl.
CPC ..... *B65D 83/32* (2013.01); *B65D 83/62* (2013.01); *B65D 83/68* (2013.01)

(58) Field of Classification Search
CPC ..... B65D 83/32; B65D 83/62; B65D 83/68; B65D 2231/001; B65D 2231/002; B65D 2231/004; B05B 11/0043; B05B 15/005
(Continued)

(56) References Cited

U.S. PATENT DOCUMENTS 3,105,618 A * 10/1963 Whitley ..... B01L 3/0282 222/207
3,896,970 A * 7/1975 Laauwe ..... B65D 83/62 222/94
(Continued)

FOREIGN PATENT DOCUMENTS

EP 0585908 A2 3/1994
EP 1400464 A1 3/2004
(Continued)

OTHER PUBLICATIONS

WO2013031546A1—English Translation, machine generated Jul. 2017.*
International Search Report dated Jun. 2, 2015, issued in counterpart application No. PCT/JP2015/062557. (2 pages).

*Primary Examiner* — Benjamin R Shaw
(74) *Attorney, Agent, or Firm* — Westerman, Hattori, Daniels & Adrian, LLP

(57) ABSTRACT

An object of the present invention is to provide a remaining-amount reduction member capable of preventing the generation of space whose periphery is closed by pressurized fluid, reducing a final remaining amount of a content to be ejected, stabilizing an ejection amount of the content per unit time, and smoothly ejecting the content to the end.
Provided is a remaining-amount reduction member 110 that is attached inside a flexible interior bag 102 arranged inside an aerosol container 100, the remaining-amount reduction member including: an attachment part 120 attached such that the content F is capable of flowing in an inflow port 103 of the interior bag 102; and a guiding part 130 having a plurality of grooved blocks 132, each of which has a guiding groove 131 in a longitudinal direction, connected in the longitudinal direction.

8 Claims, 16 Drawing Sheets

(51) Int. Cl.
*B65D 83/62* (2006.01)
*B65D 83/68* (2006.01)

(58) Field of Classification Search
USPC .... 222/105, 95, 464.1, 464.2, 464.7, 94, 92; 239/337, 33
See application file for complete search history.

(56) References Cited

U.S. PATENT DOCUMENTS 3,981,415 A * 9/1976 Fowler ..... B65D 83/0061 222/105
4,809,884 A * 3/1989 Stackhouse ..... B67D 1/045 222/153.04
5,261,565 A * 11/1993 Drobish ..... B05B 11/047 137/843
5,277,015 A * 1/1994 Brown ..... B05B 11/048 222/105
5,282,304 A * 2/1994 Reiboldt ..... B05B 11/047 29/451
5,660,477 A * 8/1997 Ichikawa ..... B29C 66/53263 222/211
9,315,315 B2 * 4/2016 Hanai ..... B65D 83/32
2013/0270294 A1 * 10/2013 Shibata ..... B65D 83/48 222/94
2014/0008389 A1 * 1/2014 Mekata ..... B65D 83/20 222/94
2014/0197200 A1 * 7/2014 Hanai ..... B65D 83/62 222/95
2014/0209632 A1 * 7/2014 Kuriyama ..... B65D 83/62 222/94
2015/0014990 A1 * 1/2015 Bodet ..... B65D 83/32 285/406
2015/0344214 A1 * 12/2015 Yamaguchi ..... B65D 83/38 222/95

FOREIGN PATENT DOCUMENTS

FR 2067476 A5 8/1971
JP 11-105893 A 4/1999
JP 2004-75099 A 3/2004
JP 2005-231644 A 9/2005
JP 5279970 B1 9/2013
JP 2015-58980 A 3/2015
WO 2013/031546 A1 3/2013
WO WO 2013031546 A1 * 3/2013 ..... B65D 83/32
WO 2013/131846 A1 9/2013
WO 2013/191248 A1 12/2013

* cited by examiner

Related Art

Fig. 8

| | | FILLING AMOUNT |
|---|---|---|
| FIRST AGENT | VISCOSITY : 21,500mPa· sec(20℃) | 50g |
| SECOND AGENT | VISCOSITY : 21,500mPa· sec(20℃) | 50g |
| PRODUCT INTERNAL PRESSURE | 0.70MPa ( at 25℃ ) | |

| | PRESENT INVENTION | | CONVENTIONAL INVENTION | | DIP TUBE | |
|---|---|---|---|---|---|---|
| | FIRST AGENT | SECOND AGENT | FIRST AGENT | SECOND AGENT | FIRST AGENT | SECOND AGENT |
| INITIAL INJECTION AMOUNT (g/5s) | 14.9 | 14.9 | 14.1 | 14.2 | 14.2 | 14.2 |
| REMAINING AMOUNT (g) | 0.6 | 0.6 | 1.6 | 0.3 | 4.6 | 1.0 |

Related Art

Related Art

Related Art

Related Art

REMAINING-AMOUNT REDUCTION MEMBER

TECHNICAL FIELD

The present invention relates to a remaining-amount reduction member that is attached inside a flexible interior bag arranged inside an aerosol container and used to reduce a final remaining amount of a content to be ejected.

BACKGROUND ART

There have been known aerosol containers configured to have a flexible interior bag arranged and integrated inside an exterior can, accommodate a content to be ejected in the interior bag, and fill the space between the interior bag and the exterior can with pressurized fluid to press the flexible interior bag and eject the content accommodated in the interior bag to an outside via an inflow port (see, for example, PTL 1 or the like).

In such aerosol containers, it is possible to use any pressurized fluid since a content does not contact the pressurized fluid. In addition, the content can be efficiently ejected since pressurized fluid is not ejected together with the content.

In these aerosol containers, space whose periphery is closed by wrinkles or curves caused in an interior bag is generated when a remaining amount of a content to be ejected from the flexible interior bag reduces, whereby the content is caused to inevitably remain in the space to the end.

In order to reduce such a final remaining amount, there have been known ones that have a dip tube as a remaining-amount reduction member and are capable of ejecting a content from both the vicinity of an inflow port and the tip of the dip tube to an outside.

As an aerosol container having a dip tube, there has been known one shown in FIG. 13.

In this example, an interior bag 502 accommodating a content F is provided inside an exterior can 501 of an aerosol container 500, and the interior bag 502 is provided with a spout 504 having a stem 505 at its upper part and an inflow port 503 opened inside the spout 504.

The space between the exterior can 501 and the interior bag 502 is filled with pressurized fluid G such as nitrogen gas. When the stem 505 is pressed, the content accommodated in the interior bag 502 flows in the inflow port 503 to be ejected to an outside from the tip of the stem 505.

Then, a dip tube 511 serving as a remaining-amount reduction member is inserted in the inflow port 503. On this occasion, the inner periphery of the inflow port 503 is formed such that a flow path for the content F is secured between the inner periphery and the dip tube 511. As shown by an arrow, the content F is guided from both the vicinity of the inflow port 503 and the vicinity of the tip of the dip tube 511 to the direction of the stem 505 to be ejected to the outside.

In addition, as shown in FIG. 14B, there has been known an aerosol container configured to have a plurality of flexible interior bags arranged in one exterior can, accommodate different types of contents so as not to be mixed together, and eject the contents at the same time.

Such an aerosol container does not require the connection of a plurality of external cans or the installation of a special structure inside the aerosol container, completely prevents the mixture of contents before the contents are ejected, and requires only one time to fill one external can with pressurized fluid, which facilitates the manufacturing of the aerosol container (see, for example, PTL 2 or the like).

CITATION LIST

Patent Literature

[PTL 1] Japanese Patent Application Laid-open No. 2004-75099 (all pages and all figures)

[PTL 2] Japanese Patent Application Laid-open No. 2005-231644 (all pages and all figures)

[PTL 3] Japanese Patent Application Laid-open No. H11-105893 (all pages and all figures)

[PTL 4] Japanese Patent No. 5279970 (all pages and all figures)

SUMMARY OF INVENTION

Technical Problem

A content inevitably remaining in known aerosol containers as described in PTLs 1 and 2 is reduced to an certain extent by the installation of a dip tube serving as a known remaining-amount reduction member as described above, and a final remaining amount can be reduced. However, when space whose periphery is closed is generated at an intermediate position distant from both the vicinity of an inflow port and the tip of the dip tube, the content still inevitably remains, which gives rise to a problem that the content also remains inside the dip tube.

Meanwhile, there have been known ones, in which a rigidity rod-shaped body having a plurality of hollowed-out parts extends via an inflow port to an inside, as remaining-amount reduction members used to completely take out a content from a flexible container other than the interior bag of an aerosol container (see, for example, PTL 3 or the like).

However, a known remaining-amount reduction member as described in PTL 3 is configured on the premise that a content is pressed by a person's hand from the outside of a flexible container to be directed to an inflow port.

Accordingly, in the interior bags of aerosol containers the entire body of which is uniformly pressed by pressurized fluid, a content remaining in space whose periphery is closed cannot be guided to an inflow port by these remaining-amount reduction members. On the contrary, protrusion parts or hollowed-out parts provided in the known remaining-amount reduction members become a factor causing an increase in closed space, which gives rise to a problem that a remaining amount increases.

In addition, even if the pressure of pressurized fluid increases, the closing force of space whose periphery is closed also increases, which does not contributes to reduction in a remaining amount of a content.

Accordingly, in order to solve the problems residing in the known remaining-amount reduction members described above, the inventors have proposed, as shown in FIG. 15, a remaining-amount reduction member 610 that is formed of a solid rod-shaped body, has attachment parts 620 attached such that a content is capable of flowing in the inflow port of an interior bag, and a guiding part 630 provided with a plurality of guiding grooves 631 in the longitudinal direction of its outer periphery, wherein the part with the guiding grooves 631 has a uniform cross-sectional shape in the longitudinal direction, and an overlap preventing part 640 formed to have a cross-sectional shape different from that of the part with the guiding grooves 631 is provided at an intermediate position in the longitudinal direction of the guiding part 630 (see PTL 4).

According to the remaining-amount reduction member 610 known in PTL 4, the guiding part 630 with the plurality of guiding grooves 631 in the longitudinal direction of the outer periphery functions as a path for causing a content to flow toward the inflow port even if a remaining amount of the content reduces. Therefore, the generation of space whose periphery is closed by pressurized fluid can be prevented over the entire length of the remaining-amount reduction member 610, and a final remaining amount of the content to be ejected can be reduced.

In addition, the interior bag itself deforms up to the inside of the guiding grooves 631 by pressure at the final stage of the ejection of the content. Therefore, the content remaining in the guiding grooves 631 is very small, and the content remaining inside the remaining-amount reduction member 610 itself can be made extremely small.

Moreover, the overlap preventing part 640 can prevent two remaining-amount reduction members 610 from overlapping and hardly separating from each other. Therefore, even if a plurality of remaining-amount reduction members 610 is collectively supplied in a manufacturing step, they can be taken out one by one, which facilitates an attachment operation.

However, as shown in FIG. 16B, flow paths R through which the content passes in the remaining-amount reduction member 610 known in PTL 4 are formed by, when the interior bag sticks to the flow paths R without a gap, four small triangular-shaped space in the part of the plurality of guiding grooves 631 and four further smaller triangular-shaped space (areas painted in black) in the overlap preventing part 640.

These flow paths R secure minimum space and are not closed to the end even when the interior bag sticks to the flow paths R without a gap. However, the resistance of the flow paths becomes large and possibly largely changes due to a change in the status of the interior bag during ejection.

Therefore, although the content is smoothly ejected to the end and a remaining amount can be satisfactorily reduced, there is a likelihood that an ejection amount of the content per unit time cannot be stabilized according to various conditions such as the accommodation status and material of the flexible interior bag and the viscosity of the content.

Further, as shown in FIG. 14A, in the case of an aerosol container configured to have a plurality of flexible interior bags arranged in one exterior can, accommodate different types of contents so as not to be mixed together, and eject the contents at the same time, an ejection amount per unit time in each of the interior bags cannot be stabilized, whereby there is a likelihood that a desired mixture ratio is not reliably obtained.

Accordingly, the present invention has been made in order to solve the problems residing in the known remaining-amount reduction members described above and has an object of providing a remaining-amount reduction member capable of preventing the generation of space whose periphery is closed by pressurized fluid, reducing a final remaining amount of a content to be ejected, stabilizing an ejection amount of the content per unit time, and smoothly ejecting the content to the end.

Solution to Problem

In order to solve the above problems, the present invention provides a remaining-amount reduction member that is attached inside a flexible interior bag arranged inside an aerosol container and is used to reduce a final remaining amount of a content to be ejected, the remaining-amount reduction member including: an attachment part attached such that the content is capable of flowing in an inflow port of the interior bag; and a guiding part that allows a flow of the content in a longitudinal direction, wherein the guiding part has a plurality of grooved blocks connected in the longitudinal direction, each of the grooved blocks has one guiding groove in the longitudinal direction, the adjacent grooved blocks are connected such that openings of the guiding grooves thereof are oriented in 180° opposite directions, and the guiding grooves form guiding space continuing in the longitudinal direction.

In order to solve the above problems, the present invention provides an aerosol container accommodating a plurality of flexible interior bags, wherein the remaining-amount reduction member described above is attached inside each of the plurality of interior bags.

Advantageous Effects of Invention

According to the remaining-amount reduction member of the invention of claim 1, the guiding part has the plurality of grooved blocks connected in the longitudinal direction, each of the grooved blocks has one guiding groove in the longitudinal direction, and the guiding grooves form the guiding space continuing in the longitudinal direction. Thus, even when a remaining amount of a content reduces, the guiding grooves are opened on the side of an outer periphery at all parts in the longitudinal direction of the outer periphery and the guiding space continuing in the longitudinal direction functions as a path for causing the content to flow toward the inflow port. Therefore, the generation of space whose periphery is closed can be prevented over the entire length of the remaining-amount reduction member, and a final remaining amount of the content to be ejected can be reduced.

In addition, a sufficient flow amount can be secured to the end without depending on the status or material of the flexible interior bag since the guiding space continuing in the longitudinal direction can be caused to have a desired cross-sectional area. Therefore, it becomes possible to stabilize an ejection amount of the content per unit time, and becomes possible to reliably obtain a desired mixture ratio when a plurality of flexible interior bags is arranged in one exterior can.

Moreover, the adjacent grooved blocks are connected such that the openings of the guiding grooves thereof are oriented in the 180° opposite directions. Therefore, when the grooved blocks are manufactured using a die for injection molding or the like, it is possible to manufacture the grooved blocks using a two-split die. In addition, since the shape of the grooved blocks is simple, the manufacturing easiness and inexpensive costs of the grooved blocks are achieved.

According to the configuration of claim 2, each of the grooved blocks is formed to have an outer peripheral shape having an arc surface of over 180° and a groove forming surface, and each of the guiding grooves is formed to range from the groove forming surface in a direction toward an arc center and has a depth exceeding the arc center. Thus, the large openings of the guiding grooves and the guiding space having a large cross-sectional area can be secured while securing joining strength with respect to the adjacent grooved blocks. In addition, it becomes possible to reduce a final remaining amount of the content to be ejected and stabilize an ejection amount of the content with reduction in the resistance of a flow path.

According to the configuration of claim 3, the arc surface has an outer-surface groove, which extends in the longitudinal direction, at a position at which the outer-surface groove does not overlap with the arc surface of the adjacent grooved block. Thus, besides the central guiding space, a guiding path for the content is also formed on an outer-surface side by the outer-surface groove in the longitudinal direction. In addition, since the content smoothly flows in the inflow port, it becomes possible to stabilize an ejection amount of the content.

According to the configuration of claim 4, a connection neck part is provided between the attachment part and the grooved blocks, the connection neck part has an opening part opened on the side of the guiding groove of the adjacent grooved block and a 180° opposite side thereof, and the opening part communicates with the guiding space. Thus, it becomes possible to split the content, which flows from the guiding space toward the inflow port of the interior bag, into both sides of the attachment part. Therefore, since the content smoothly flows in the inflow port, it becomes possible to further stabilize an ejection amount of the content.

According to the configuration of claim 5, an odd number of the grooved blocks are connected. Thus, when the remaining-amount reduction member is molded using a resin or the like, the resin can be injected from the part of a grooved block positioned at the center in the longitudinal direction. Therefore, it becomes possible to uniformly inject the resin into a die toward both ends in the longitudinal direction. Therefore, the remaining-amount reduction member with high accuracy and uniformity can be achieved.

According to the configuration of claim 6, it becomes possible to smoothly attach the attachment part to the inflow port and prevent the interior bag from being damaged by the corner part of the end surface of the attachment part.

According to the configuration of claim 7, it becomes possible to attach any of the ends of the remaining-amount reduction member to the inflow port. Therefore, since it is not required to adjust the direction of the remaining-amount reduction member in the longitudinal direction at manufacturing, the attachment of the remaining-amount reduction member is facilitated.

According to the aerosol container of claim 8, the remaining-amount reduction member described above is attached inside each of the plurality of interior bags. Thus, it becomes possible to stabilize an ejection amount per unit time in each of the interior bags and reliably obtain a desired mixture ratio.

BRIEF DESCRIPTION OF DRAWINGS

FIGS. 4A-4C show the remaining-amount reduction member according to a first embodiment of the present invention wherein FIG. 4A is a cross-sectional view of FIG. 2, FIG. 4B is a partially-enlarged view of FIG. 2, and FIG. 4C is an A-A' cross-sectional view;

FIG. 8 is a table showing the conditions and results of the injection experiments shown in FIG. 5 to FIG. 7;

FIGS. 12A-12B show the remaining-amount reduction member according to the second embodiment of the present invention wherein FIG. 12A is a cross-sectional view of FIG. 10 and FIG. 12B is a B-B cross-sectional view;

FIGS. 14A-14B show two-component simultaneous ejection aerosol containers wherein FIG. 14A is a view for describing the cross section of a two-component simultaneous ejection aerosol container to which remaining-amount reduction members according to a conventional invention are attached and FIG. 14B is a view for describing the cross section of a two-component simultaneous ejection aerosol container to which conventional dip tubes are attached;

FIGS. 16A-16B show the remaining-amount reduction member according to the first embodiment of the present invention and the remaining-amount reduction member according to the conventional invention wherein FIG. 16A shows a perspective view of the remaining-amount reduction member according to the first embodiment of the present invention and an A-A' cross-sectional view and FIG. 16B shows a perspective view of the remaining-amount reduction member according to the conventional invention, an A-A' cross-sectional view, and a B-B' cross-sectional view.

REFERENCE SIGNS LIST

Figure 1:
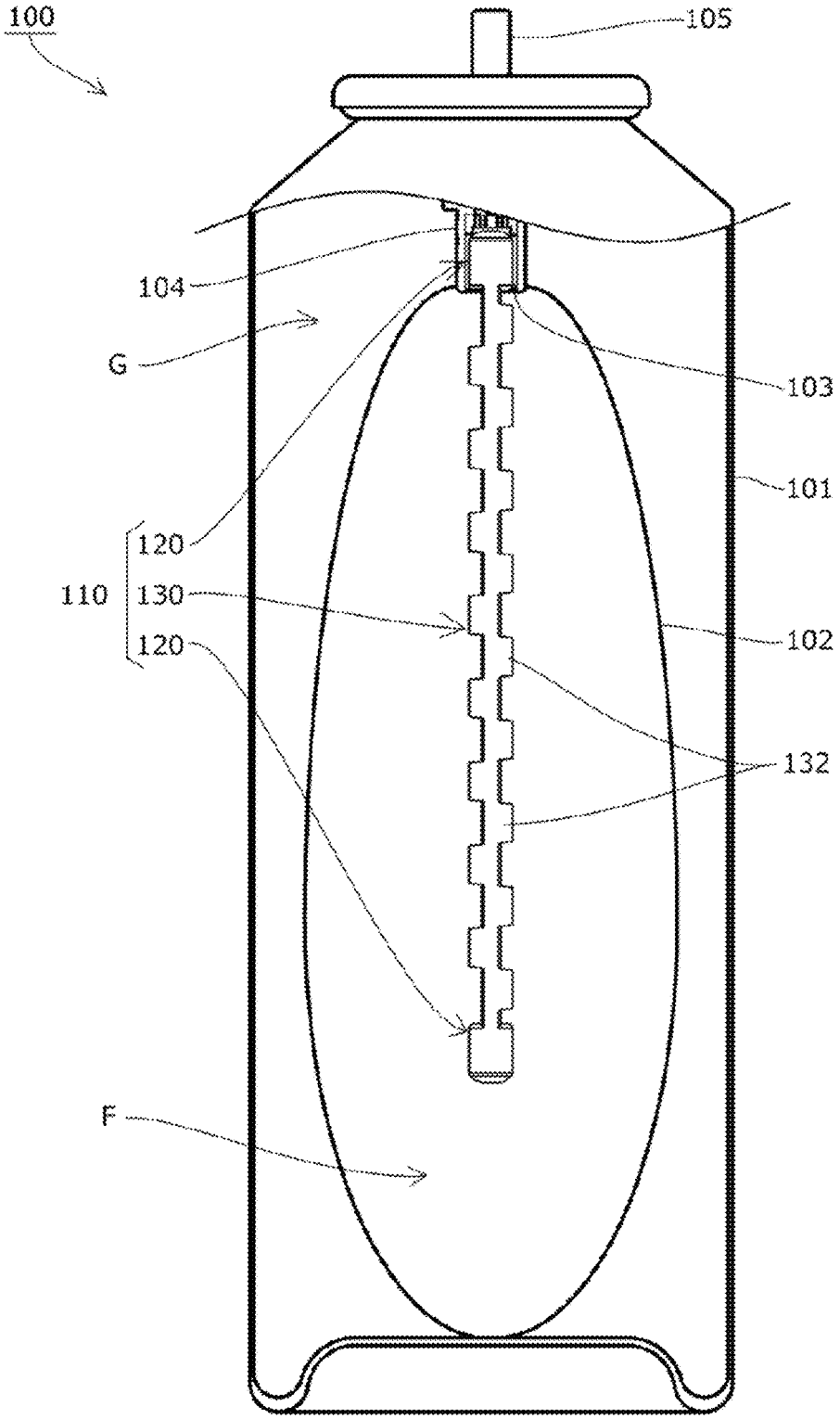
FIG. 1 is a view for describing the cross section of an aerosol container to which the remaining-amount reduction member of the present invention is attached.
Figure 2:
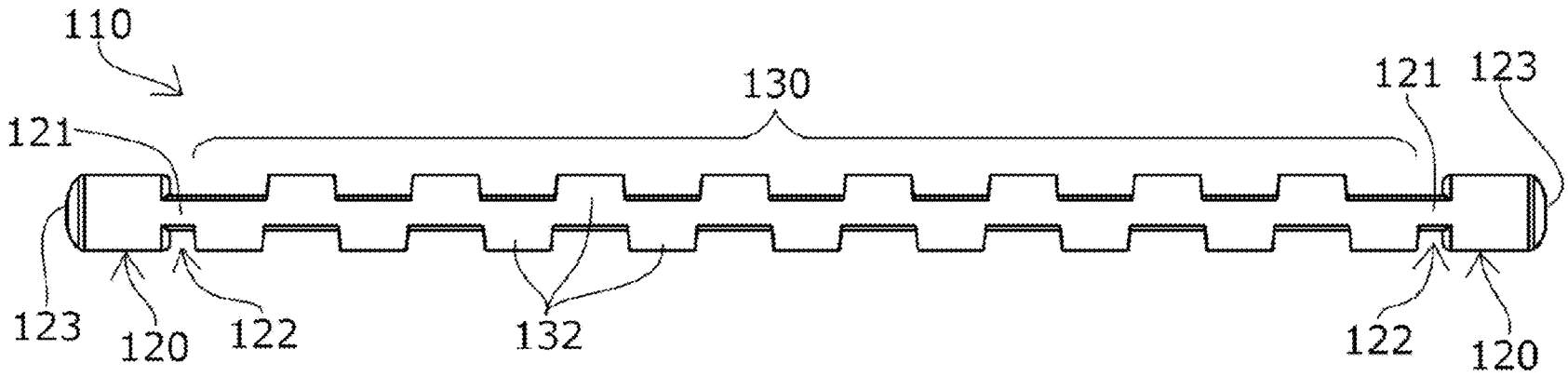
FIG. 2 is a front view of the remaining-amount reduction member according to a first embodiment of the present invention.
Figure 3:
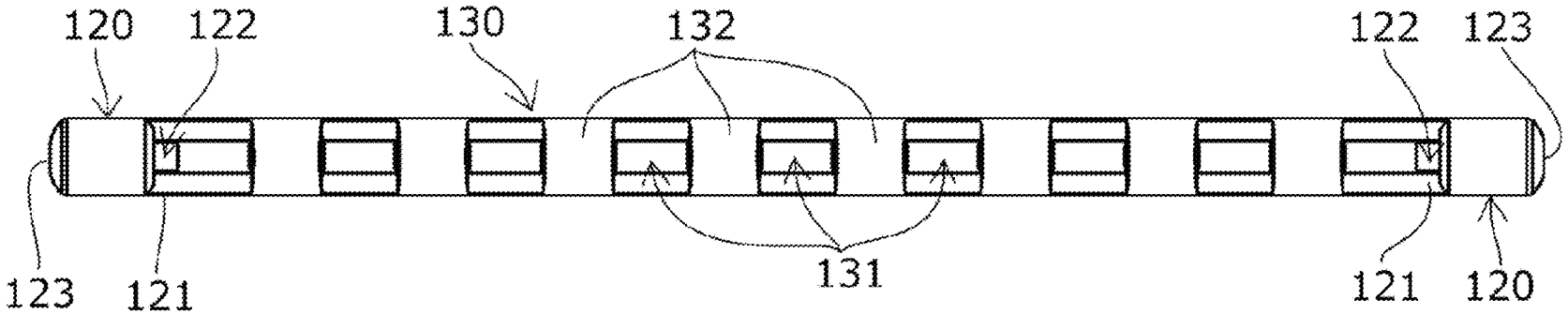
FIG. 3 is a side view of FIG. 2.

100, 500: Aerosol container
101, 501: Exterior can
102, 502: Interior bag
103, 503: Inflow port
104, 504: Spout
105, 505: Stem
110, 210, 610: Remaining-amount reduction member
511: Dip tube (Remaining-amount reduction member)
120, 220, 620: Attachment part
121, 221: Connection neck part
122, 222: Opening part
123, 223: End surface
130, 230, 630: Guiding part
131, 231, 631: Guiding groove
132, 232: Grooved block
133, 233: Arc surface
134, 234: Groove forming surface

135, 235: Guiding space
136, 236: Connection surface
137, 237: Gate
238: Outer-surface groove
640: Overlap preventing part
F: Content
G: Pressurized fluid

[Description of Embodiments]

The remaining-amount reduction member of the present invention may have any specific embodiment on the premise that the remaining-amount reduction member is attached inside a flexible interior bag arranged inside an aerosol container and is used to reduce a final remaining amount of a content to be ejected, the remaining-amount reduction member includes an attachment part attached such that the content is capable of flowing in an inflow port of the interior bag, and a guiding part that allows a flow of the content in a longitudinal direction, the guiding part has a plurality of grooved blocks connected in the longitudinal direction, each of the grooved blocks has one guiding groove in the longitudinal direction, the adjacent grooved blocks are connected such that openings of the guiding grooves thereof are oriented in 180° opposite directions, the guiding grooves form guiding space continuing in the longitudinal direction, and the remaining-amount reduction member is capable of preventing the generation of space whose periphery is closed by pressurized fluid, reducing a final remaining amount of the content to be ejected, stabilizing an ejection amount of the content per unit time, and smoothly ejecting the content to the end.

[First Embodiment]

A remaining-amount reduction member 110 according to a first embodiment of the present invention is inserted in an inflow port 103 of an aerosol container 100 similar to the known aerosol container 500 described above instead of the known dip tube 511.

That is, as shown in FIG. 1, an interior bag 102 accommodating a content F is provided inside an exterior can 101 of the aerosol container 100, and the interior bag 102 is provided with a spout 104 having a stem 105 at its upper part and the inflow port 103 opened inside the spout 104.

The space between the exterior can 101 and the interior bag 102 of the aerosol container 100 is filled with pressurized fluid G such as nitrogen gas. When the stem 105 is pressed, the content accommodated in the interior bag 102 is configured to flow in the inflow port 103 to be ejected to an outside from the tip of the stem 105.

Further, in the inflow port 103 of the interior bag 102, the remaining-amount reduction member 110 having attachment parts 120 and a guiding part 130, which represents the first embodiment of the present invention, is inserted.

On this occasion, the inner periphery of the inflow port 103 is formed such that a flow path for the content F is secured between the inner periphery and the attachment parts 120 of the remaining-amount reduction member 110.

As shown in FIG. 2 to FIG. 4 and FIG. 16A, the remaining-amount reduction member 110 has at its both ends the attachment parts 120 attachable such that the content F is capable of flowing in the inflow port 103 of the interior bag 102, and has the guiding part 130 that allows the flow of the content F in its longitudinal direction. Between the attachment parts 120 and the guiding part 130, connection neck parts 121 are formed.

The guiding part 130 has a plurality of grooved blocks 132 continuously connected in the longitudinal direction, and each of the grooved blocks 132 has one guiding groove 131 in the longitudinal direction.

Each of the grooved blocks 132 is formed to have an outer peripheral shape having an arc surface 133 of over 180° and a groove forming surface 134. Each of the guiding grooves 131 is formed to range from the groove forming surface 134 in the direction toward an arc center and have a depth exceeding the arc center.

The adjacent grooved blocks 132 are connected such that the openings of the guiding grooves 131 are oriented in 180° opposite directions, and the guiding grooves 131 form guiding space 135 continuing in the longitudinal direction.

Each of the connection neck parts 121 has an opening part 122 opened on the side of the guiding groove 131 of the adjacent grooved block 132 and its 180° opposite side, and the opening parts 122 communicate with the guiding space 135.

The attachment parts 120 are provided at both ends in the longitudinal direction of the guiding part 130, and end surfaces 123 of the attachment parts 120 are formed into a smooth convex surface shape.

Figures 4A, 4B, 4C:
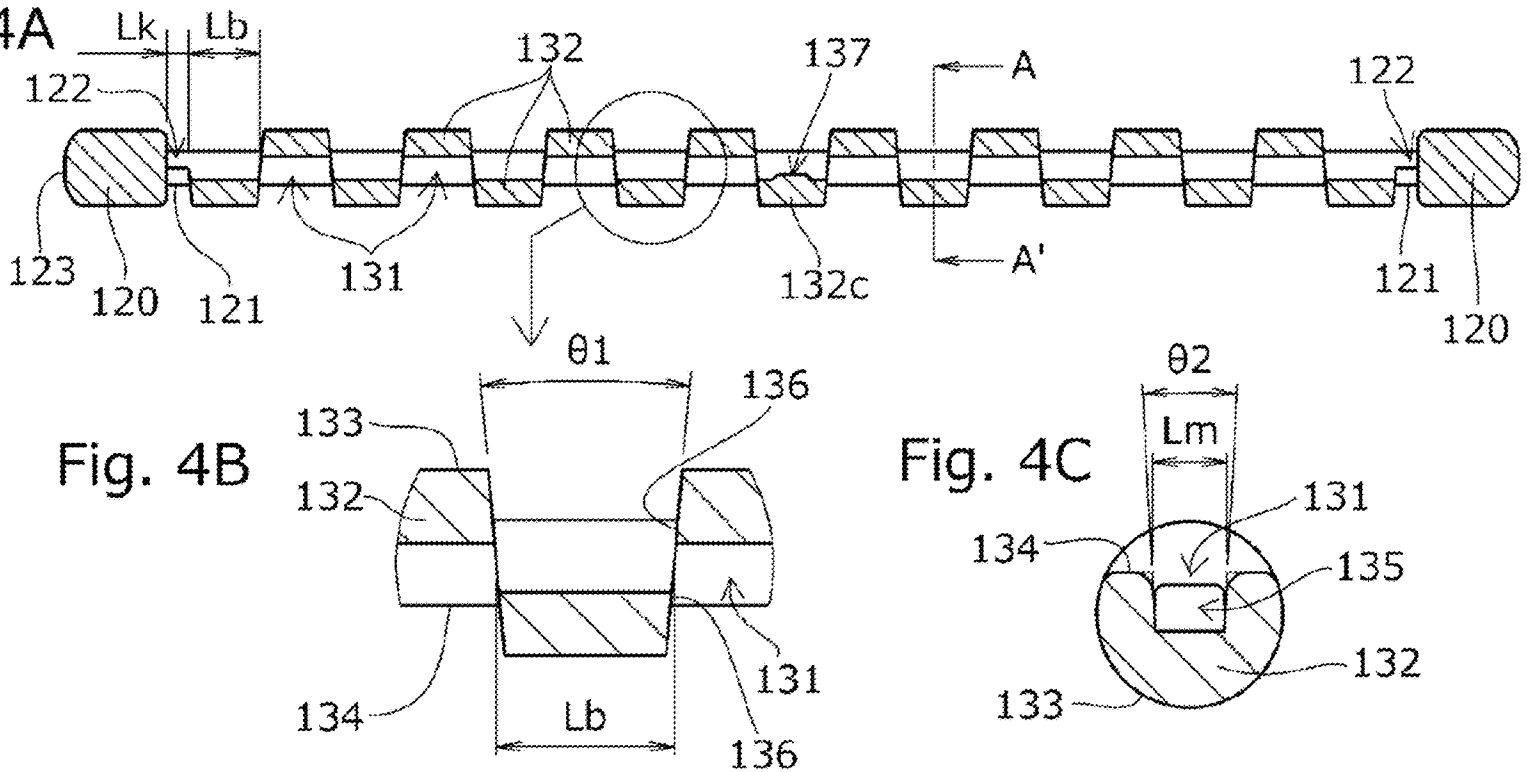

In the embodiment, the 17 grooved blocks 132 are connected in the longitudinal direction. As shown in FIG. 4, a gate 137 used to inject a resin at molding with a die is provided at a position corresponding to the bottom part of the guiding groove 131 of an exact intermediate grooved block 132*c*.

Each of the grooved blocks 132 has a length Lb of 4.2 mm in the longitudinal direction on a center line and is set such that a connection surface 136 has an opening angle θ1 of 10° with respect to the adjacent grooved block 132 in consideration of molding with a die.

In addition, the guiding grooves 131 have a width Lm of 1.78 mm and are set to have an opening angle θ2 of 6° in consideration of molding with a die.

Moreover, the connection neck parts 121 have a length Lk of 1.3 mm in the longitudinal direction.

A description will be given of the operation and function of ejecting the content F with the remaining-amount reduction member 110 thus configured, which represents the first embodiment of the present invention.

When the stem 105 is pressed, the content F accommodated in the interior bag 102 passes through the flow path secured between the inflow port 103 and the attachment part 120 of the remaining-amount reduction member 110 and is ejected from the tip of the stem 105 to the outside.

When a remaining amount of the content F accommodated in the interior bag 102 reduces, the interior bag 102 contacts the guiding part 130 of the remaining-amount reduction member 110. However, all the grooved blocks 132 have the respective guiding grooves 131 opened outward, and the guiding grooves 131 form the guiding space 135 communicating in the longitudinal direction. Therefore, the flow path for the content Fin the longitudinal direction is secured to the end, and the content F passes through the connection neck part 121 provided between the attachment part 120 and the guiding part 130 and is reliably introduced into the inflow port 103.

Accordingly, the content F can be caused to flow toward the inflow port 103 from anywhere over the entire length of the remaining-amount reduction member 110. Therefore, the generation of space whose periphery is closed by pressurized fluid can be prevented, and a final remaining amount of the content F to be ejected can be reduced.

Figure 16A:
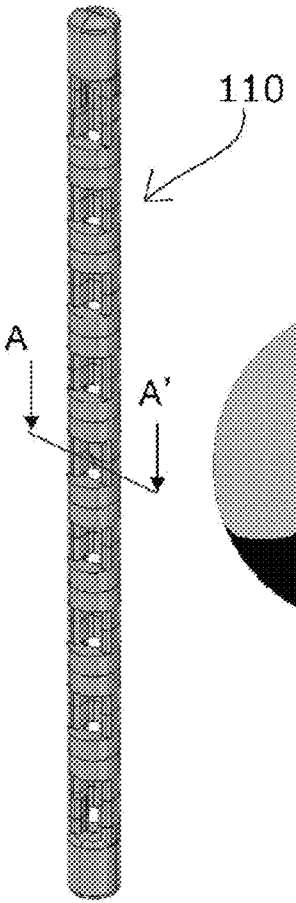
Figure 16B:
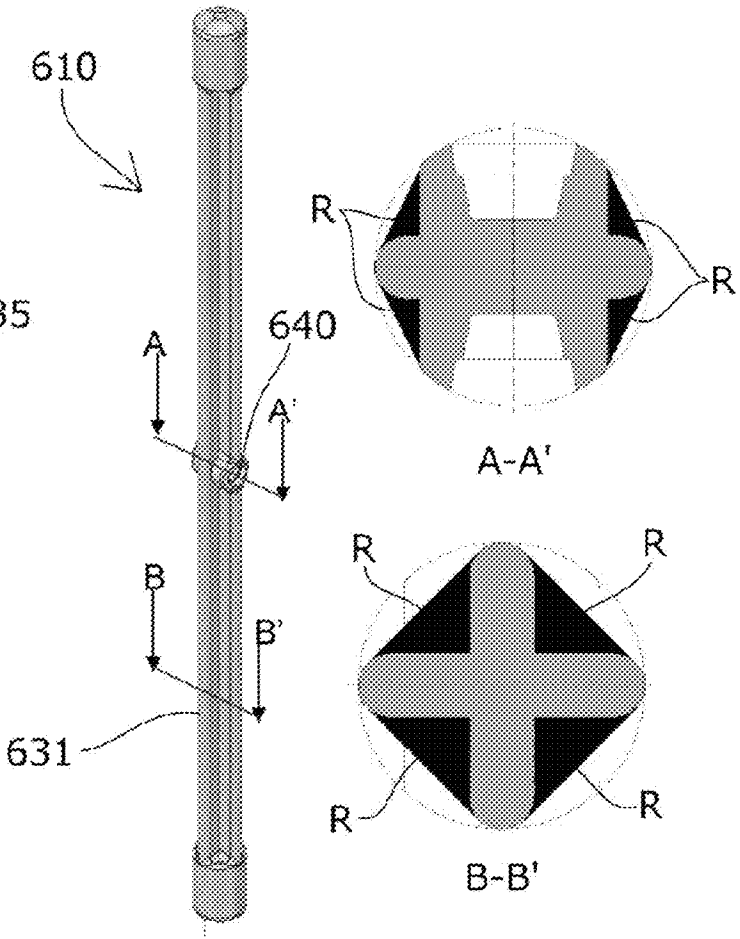

In addition, even if the interior bag 102 sticks to any of the grooved blocks 132 by pressure, a cross section R of the guiding grooves 131 forming the flow path is large and the guiding space 135 forming the flow path in the longitudinal direction is necessarily secured in the back of the guiding grooves 131 as shown in FIG. 16A. Therefore, it becomes possible to stabilize an ejection amount of the content per unit time without increasing the resistance of the flow path.

Note that the number of the grooved blocks, the dimensions of the respective parts, the angle, or the like may be appropriately set according to the shape or material of the interior bag 102, the viscosity of the content F, or the like.

In addition, the width, depth, shape, or the like of the guiding grooves 131 maybe appropriately set according to the shape or material of the interior bag 102, the viscosity of the content F, or the like.

Figure 14B:
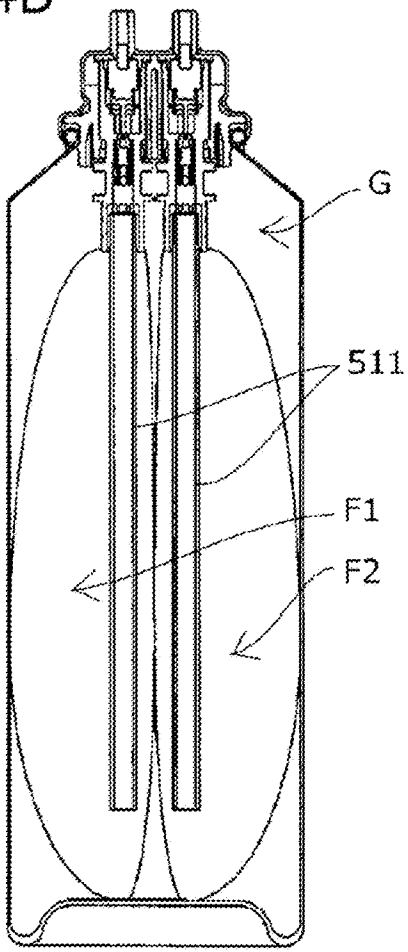
Figure 14A:
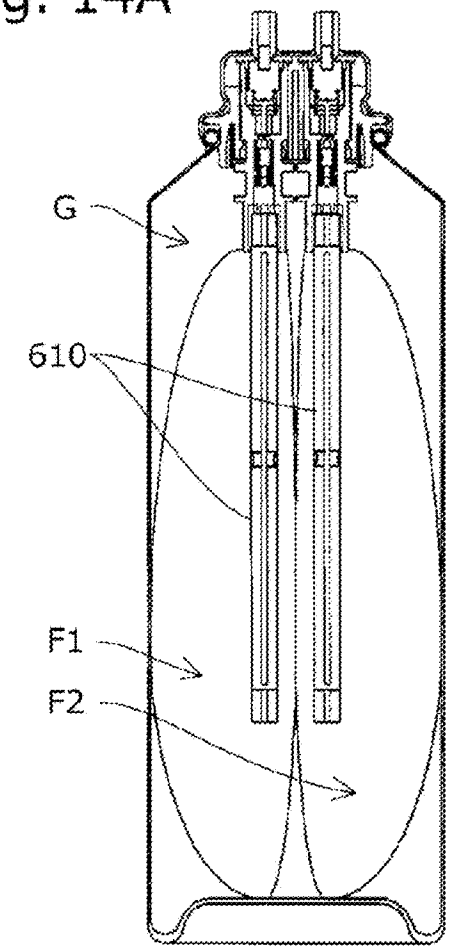
Related Art Fig. 14A
Figure 15:
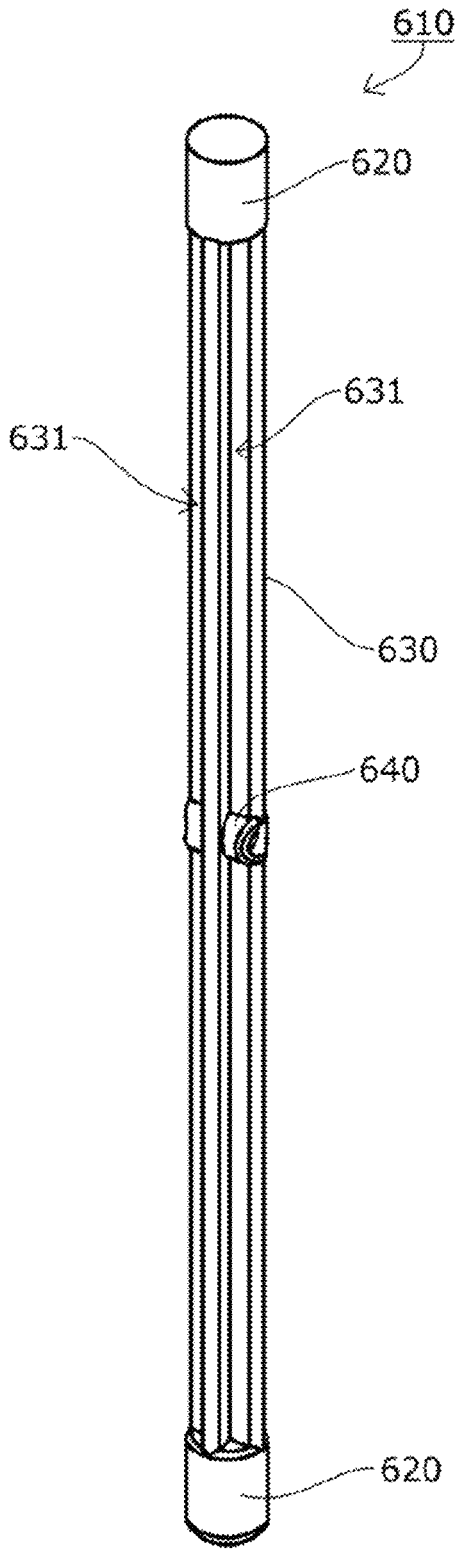
FIG. 15 is a perspective view of a conventional remaining-amount reduction member.

A description will be given of the results of a jetting experiment when the remaining-amount reduction members 110 according to the first embodiment of the present invention (hereinafter called the "present invention"), the remaining-amount reduction members 610 according to the conventional invention (hereinafter called the "conventional invention"), and the dip tubes 511 described above are used in a two-component simultaneous-ejection aerosol container as shown in FIG. 14 in which two interior bags are arranged in one exterior can.

As shown in the table of FIG. 8, the same amount of first and second agents having the same viscosity were filled, and pressure inside an aerosol can was set at 0.7 MPa (at 25° C.)

Initially, the first and second agents are jetted by a nearly equal amount with the present invention, the conventional invention, and the dip tubes as shown in the table of FIG. 8.

Figure 5:
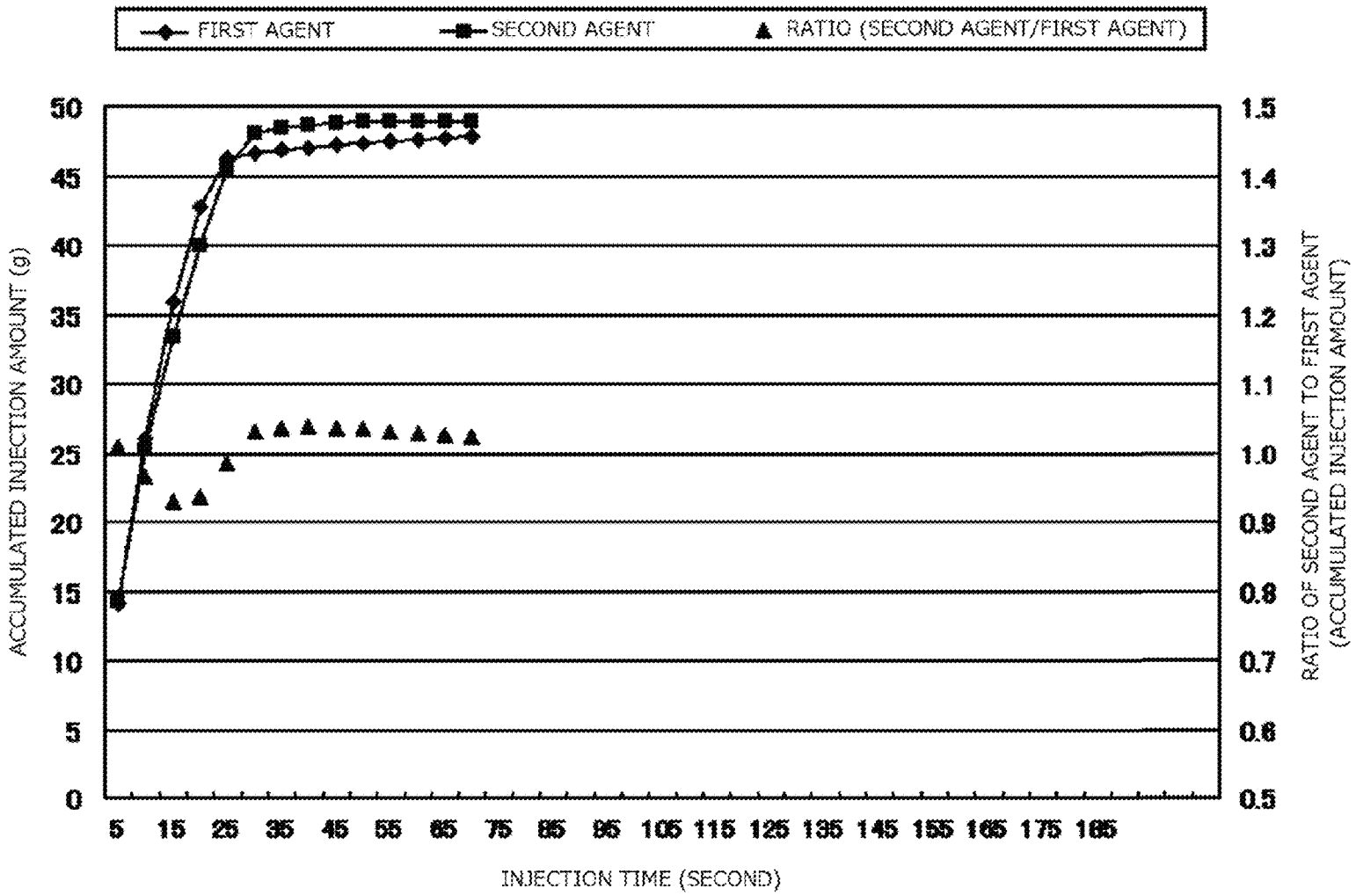
FIG. 5 is a graph showing the results of an injection experiment by a two-component simultaneous ejection aerosol container to which the remaining-amount reduction member according to the first embodiment of the present invention is attached.

As shown in FIG. 5, in the case of the present invention, the jetting was continuously performed in a state in which the ratio of the second agent to the first agent was almost equally kept at 1 or so after the initial jetting to reduce remaining amounts. Final remaining amounts of both the first and second agents were 0.6 g.

Figure 6:
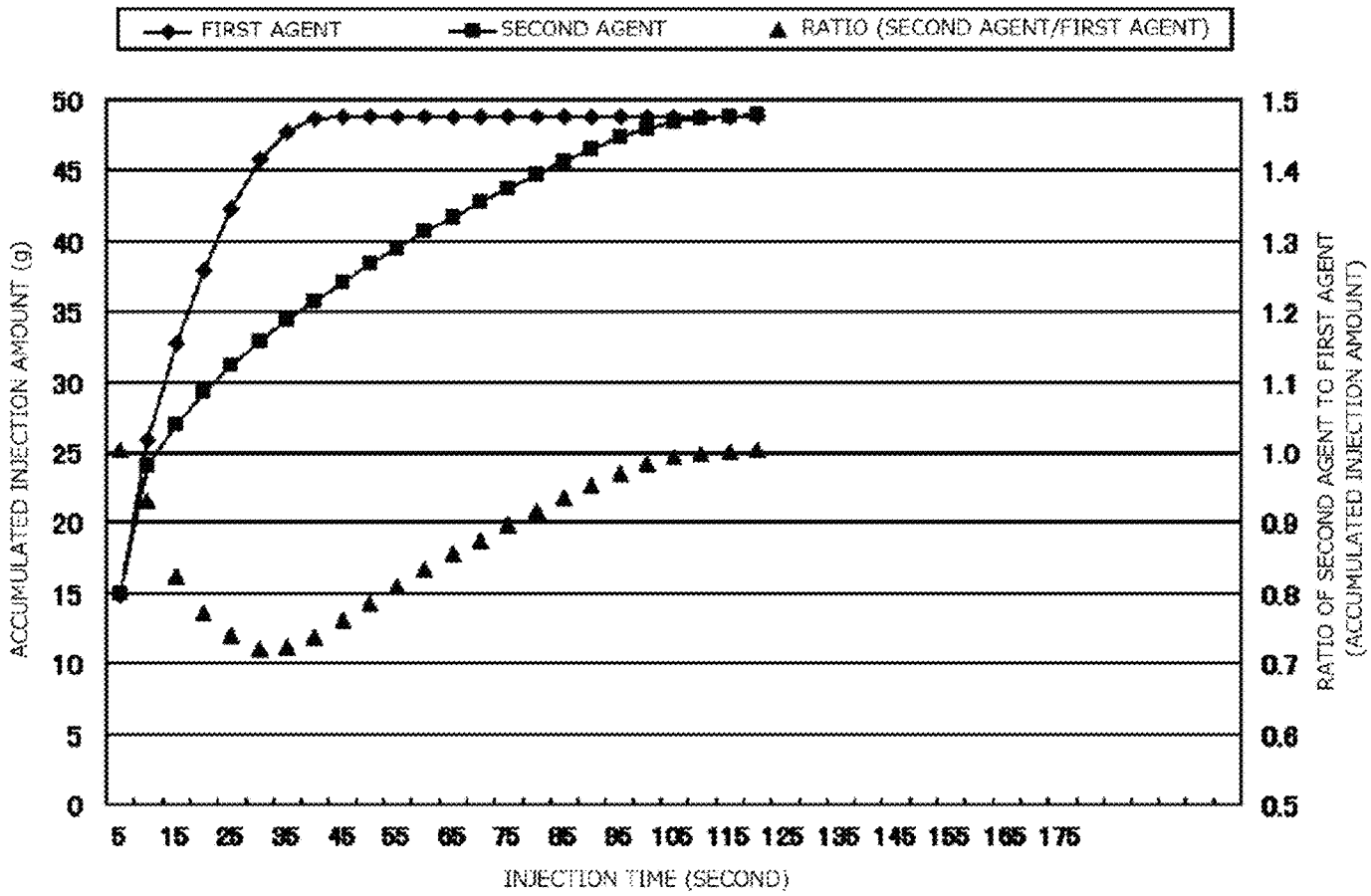
FIG. 6 is a graph showing the results of an injection experiment by a two-component simultaneous ejection aerosol container to which a remaining-amount reduction member according to a conventional invention is attached.

Conversely, in the case of the conventional invention, final remaining amounts of the first and second agents become very small, i.e., the final remaining amounts of the first and second agents were 1.6 g and 0.3 g, respectively. However, as shown in FIG. 6, jetting amounts of the first and second agents are largely different from each other, and the ratio of the second agent to the first agent continues to reduce until the jetting of the first agent is almost finished and becomes 0.7 at a maximum. After that, only the second agent is jetted.

Figure 7:
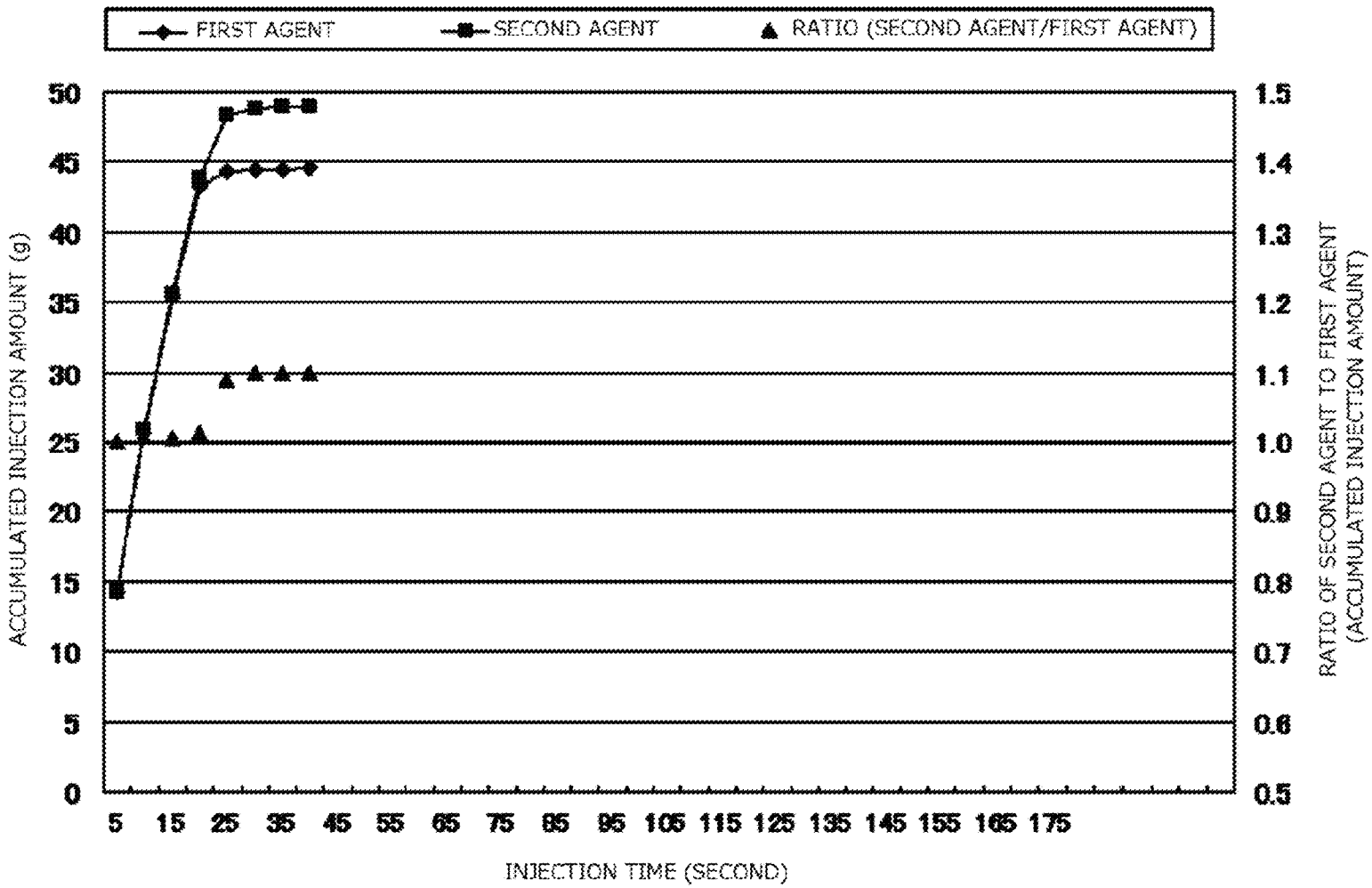
FIG. 7 is a graph showing the results of an injection experiment by a two-component simultaneous ejection aerosol container to which a dip tube is attached.
Figure 9:
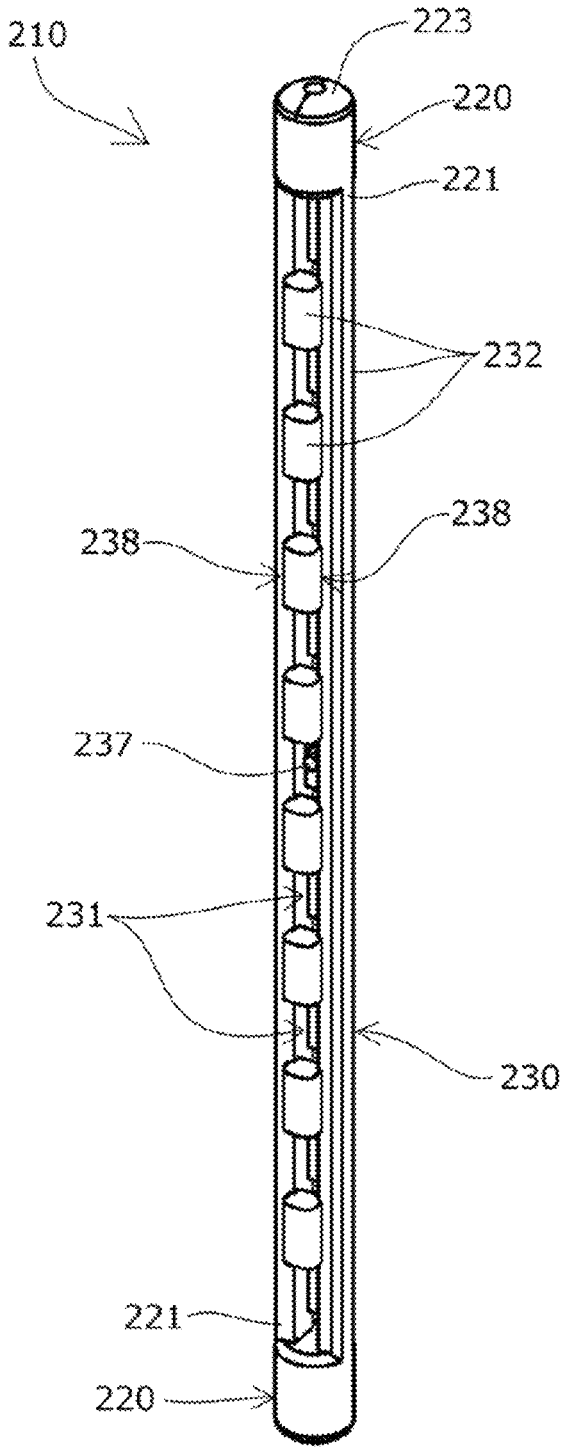
FIG. 9 is a perspective view of a remaining-amount reduction member according to a second embodiment of the present invention.
Figure 10:
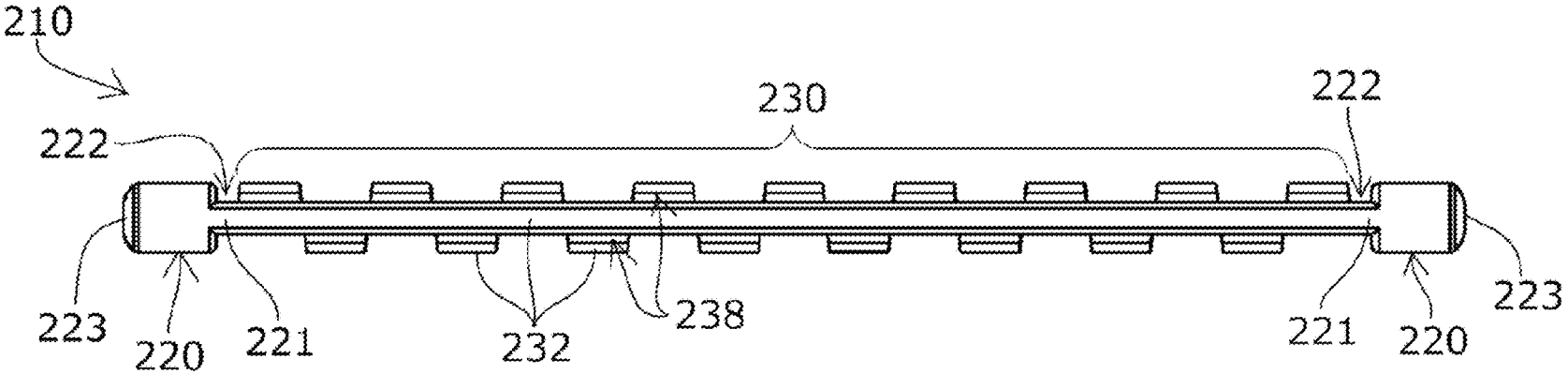
FIG. 10 is a front view of the remaining-amount reduction member according to the second embodiment of the present invention.
Figure 11:
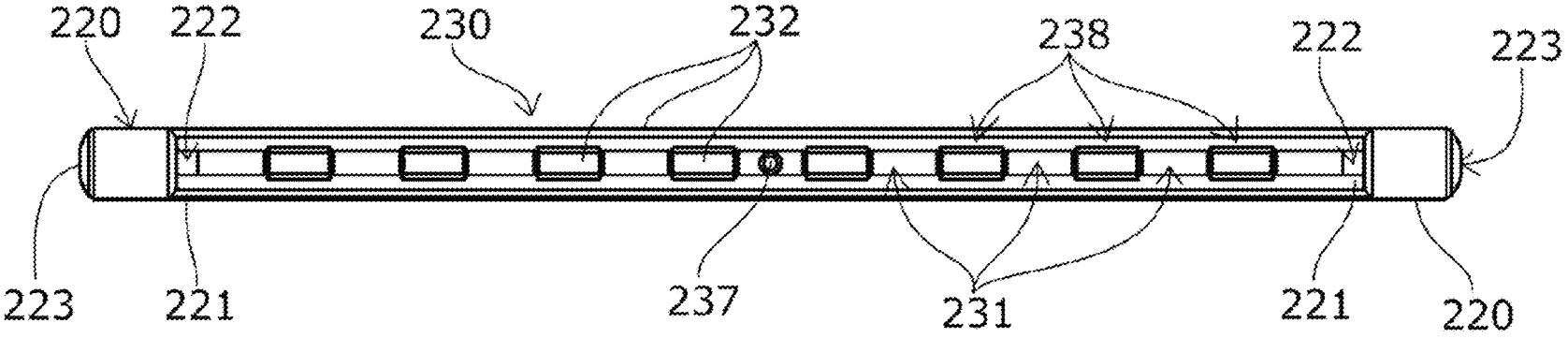
FIG. 11 is a side view of FIG. 10.

Further, in the case of the dip tubes, as shown in FIG. 7, the jetting is continuously performed in a state in which the ratio of the second agent to the first agent is nearly equally kept at 1 or so to reduce remaining amounts. However, final remaining amounts become very large, i.e., the final remaining amounts of the first and second agents are 4.6 g and 1.0 g, respectively.

As is also clear from the experimental results, the final remaining amounts with the remaining-amount reduction members of the present invention are as small as those with the remaining-amount reduction members of the conventional invention, and the ratio of the second agent to the first agent in the jetting with the remaining-amount reduction members of the present invention is as equal as that with the dip tubes. Thus, it appears that the remaining-amount reduction members of the present invention reduce final remaining amounts of contents to be ejected, stabilizes ejection amounts of the contents per unit time, and smoothly ejects the contents to the end.

[Second Embodiment]

As shown in FIG. 9 to FIG. 12, a remaining-amount reduction member 210 according to a second embodiment of the present invention has, besides the configuration of the remaining-amount reduction member 110 according to the first embodiment described above, a configuration in which arc surfaces 233 have two respective outer-surface grooves 238 extending in the longitudinal direction at their positions at which the outer-surface grooves 238 do not overlap with the arc surfaces 233 of adjacent grooved blocks 232 in the longitudinal direction (the same constituents as those of the first embodiment are shown in the figures by corresponding reference signs in the 200s and their descriptions will be omitted).

Figure 12A:
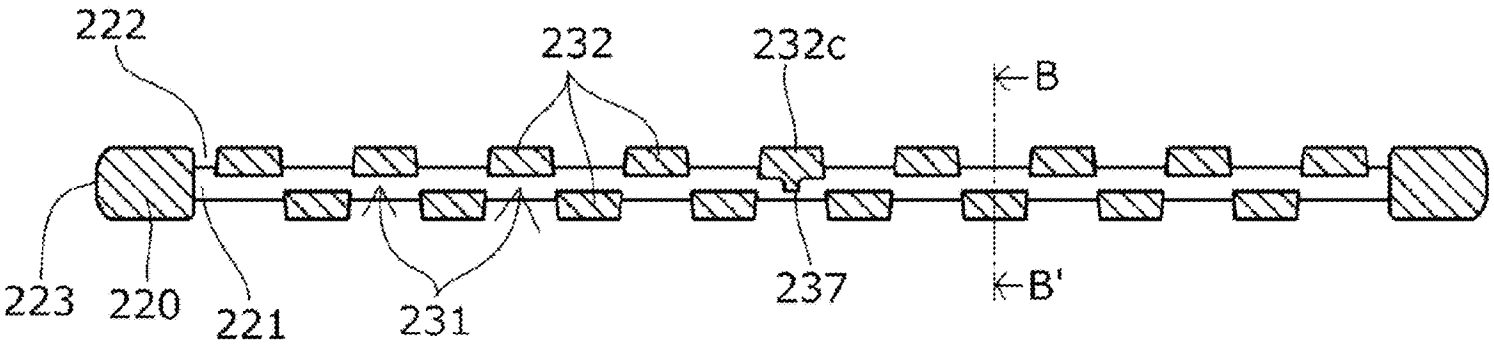
Figure 12B:
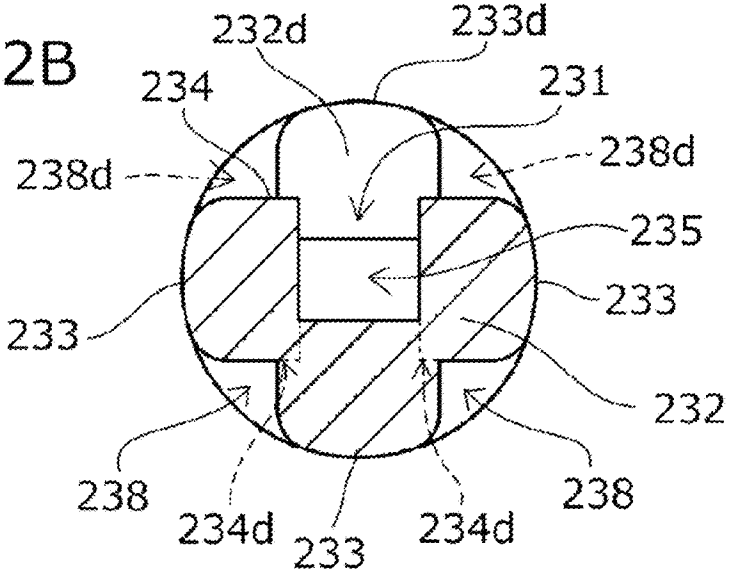
Figure 13:
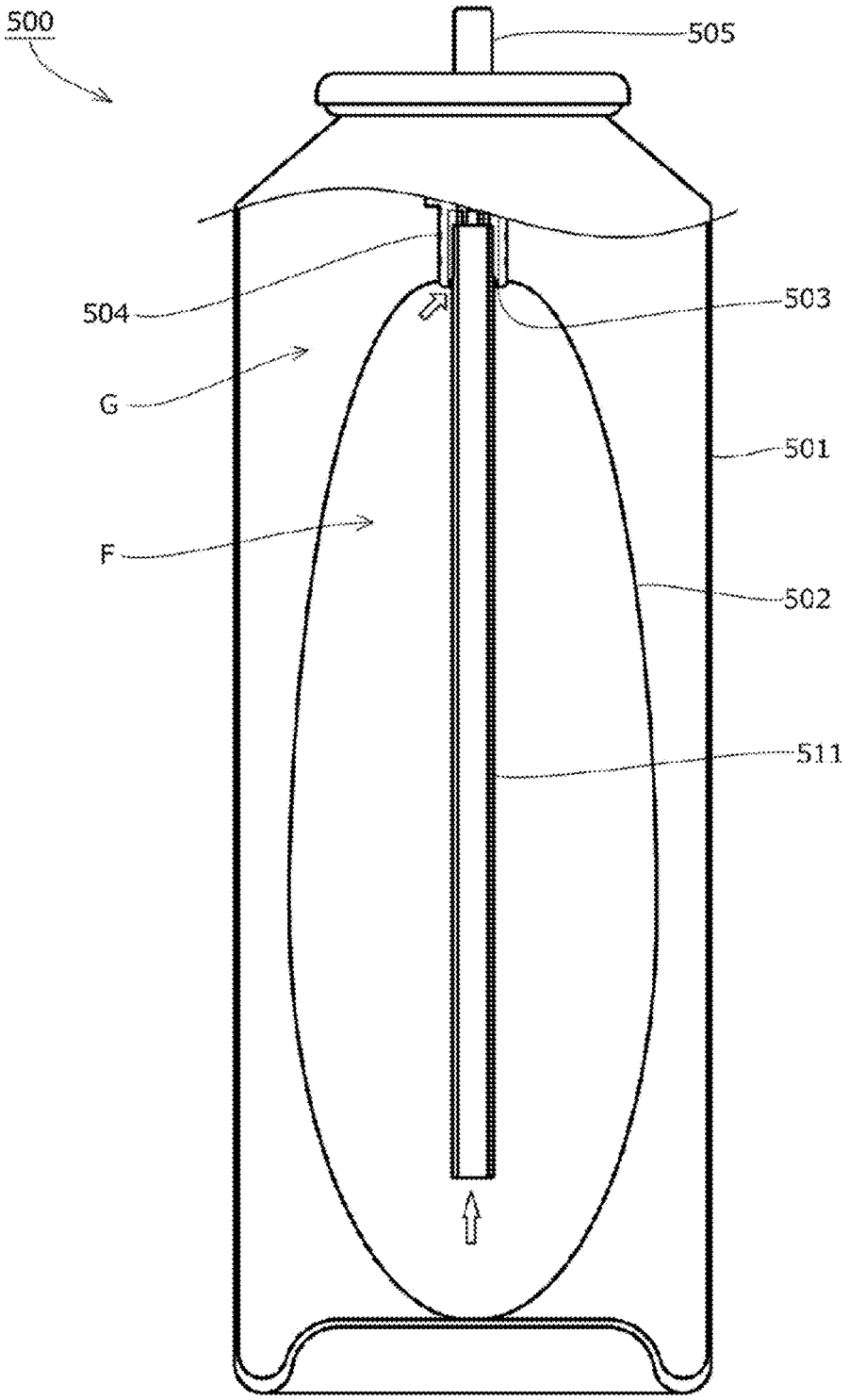
FIG. 13 is a view for describing the cross section of an aerosol container to which a conventional remaining-amount reduction member (dip tube) is attached.

As shown in FIG. 12B, the outer-surface grooves 238 are provided at the two spots of the arc surface 233 of each of the grooved blocks 232 so as to extend in the longitudinal direction.

In the embodiment, the outer-surface grooves are formed at exact positions and have an exact cross-sectional shape such that they do not overlap with arc surfaces 233*d* of adjacent grooved blocks 232*d*, i.e., the outer-surface grooves are formed at positions and have a cross-sectional shape such that they form surfaces continuing to groove forming surfaces 234*d*.

Thus, besides guiding space 235 in which space on the outside of groove forming surfaces 234 and the outer-surface grooves 238 of the respective grooved blocks 232 are alternately arranged in the longitudinal direction to be linearly continuous to continuously form central guiding grooves 231, a guiding path on the side of an outer surface similar to that of the conventional invention shown in the experimental example described above is formed. Asa result, since a content further smoothly flows toward an inflow port, it becomes possible to stabilize an ejection amount of the content.

Note that in the embodiment, the guiding grooves 231 are formed into a shape different from that of the guiding grooves 131 of the first embodiment. However, the guiding grooves 231 may be formed into an appropriate shape according to the viscosity of content liquid, the material of an interior bag, or the like and in consideration of manufacturing easiness or the like.

INDUSTRIAL APPLICABILITY

The remaining-amount reduction member of the present invention may be used not only in each interior bag of general aerosol containers having one interior bag or aerosol containers having two interior bags accommodating different contents but also in aerosol containers having a multiplicity of interior bags. It is possible to design specific shapes using the technical features of the present invention according to various use modes and appropriately modify the remaining-amount reduction member according to the contours or shapes of aerosol containers.

In addition, the remaining-amount reduction member may be used not only in aerosol containers but also in flexible containers to be pressed by a person's hand from the outside of the containers such that a content flows toward an inflow port or containers having other press means.

The invention claimed is:

1. A remaining-amount reduction member that is attached inside a flexible interior bag arranged inside an aerosol container and is used to reduce a final remaining amount of a content to be ejected, the remaining-amount reduction member comprising:

an attachment part attached such that the content is capable of flowing in an inflow port of the interior bag; and a guiding part that allows a flow of the content in a longitudinal direction, wherein the guiding part has a plurality of grooved blocks connected in the longitudinal direction, each of the grooved blocks has one guiding groove in the longitudinal direction, the adjacent grooved blocks are connected such that openings of the guiding grooves thereof are oriented in alternating 180° opposite directions, relative to a longitudinal axis of the remaining-amount reduction member, and the guiding grooves communicate with each other in a longitudinal axial direction of the remaining-amount reduction member to cumulatively form a guiding space continuing in the longitudinal direction.

2. The remaining-amount reduction member according to claim 1, wherein each of the grooved blocks is formed to have an outer peripheral shape having a groove forming surface and an arc surface of greater than 180° relative to the longitudinal axis of the remaining-amount reduction member, and each of the guiding grooves is formed from the groove forming surface in a direction toward an arc center and has a depth exceeding the arc center.

3. The remaining-amount reduction member according to claim 2, wherein the arc surface has at least one outer-surface groove, which extends in the longitudinal direction, at a position at which the outer-surface groove does not overlap with the arc surface of the adjacent grooved block in the longitudinal direction.

4. The remaining-amount reduction member according to claim 1, wherein a connection neck part is provided between the attachment part and the grooved blocks, the connection neck part has an opening part opened on the side of the guiding groove of the adjacent grooved block and a 180° opposite side thereof, relative to the longitudinal axis of the remaining-amount reduction member, and the opening part communicates with the guiding space.

5. The remaining-amount reduction member according to claim 1, wherein an odd number of the grooved blocks are connected.

6. The remaining-amount reduction member according to claim 1, wherein an end surface of the attachment part is formed into a smooth convex surface shape.

7. The remaining-amount reduction member according to claim 1, wherein the attachment part is provided at each of both ends in the longitudinal direction of the guiding part.

8. An aerosol container accommodating a plurality of flexible interior bags, wherein the remaining-amount reduction member according to claim 1 is attached inside each of the plurality of interior bags.

* * * * *